US007853173B2

(12) United States Patent
Perez

(10) Patent No.: US 7,853,173 B2
(45) Date of Patent: Dec. 14, 2010

(54) EXCESS TONER EVACUATION PROCESS

(75) Inventor: Jesus Gonzalez Perez, Chatsworth, CA (US)

(73) Assignee: Wazana Brothers International, Van Nuys, CA (US)

( * ) Notice: Subject to any disclaimer, the term of this patent is extended or adjusted under 35 U.S.C. 154(b) by 60 days.

(21) Appl. No.: 11/925,848

(22) Filed: Oct. 27, 2007

(65) Prior Publication Data

US 2009/0110433 A1 Apr. 30, 2009

(51) Int. Cl.
*G03G 15/00* (2006.01)

(52) U.S. Cl. ..... 399/109

(58) Field of Classification Search ..... 399/109, 399/111–114

See application file for complete search history.

(56) References Cited

U.S. PATENT DOCUMENTS 5,243,388 A * 9/1993 Berns et al. ..... 399/90
5,525,183 A 6/1996 Baley
6,088,561 A 7/2000 Kawamura
6,574,445 B2 * 6/2003 Higeta et al. ..... 399/103
6,608,983 B2 8/2003 Terazawa
2004/0131383 A1 7/2004 Fujita

FOREIGN PATENT DOCUMENTS

WO 2006109052 A1 10/2006

* cited by examiner

*Primary Examiner*—David M Gray
*Assistant Examiner*—Gregory H Curran

(57) ABSTRACT

A system and process for emptying excess toner from repaired or remanufactured laser printer toner cartridges, for use in both magnetic toner and non-magnetic toner after the cartridge has been assembled and post-assembly tested. The removal of excess toner from the cartridge prevents the cartridge from "sweating", i.e., leaking toner out from the developing roller section of the cartridge and into the shipping packaging box during shipping and storage.

6 Claims, 6 Drawing Sheets

EXCESS TONER EVACUATION PROCESS

FIELD OF INVENTION

The invention relates generally to the field of laser printer toner cartridges, and more specifically, to repair and remanufacture of such toner cartridges.

BACKGROUND OF INVENTION

Repairing and/or remanufacturing of a toner cartridge generally involve four main stages: (1) disassembly and cleaning, (2) assembly and replacement of defective parts; (3) refilling the cartridge with toner; and, (4) printing from the cartridge after it has been assembled (hereinafter referred to as post-printing).

After the toner cartridge is remanufactured and before the cartridge is shipped, typically the cartridge it tested to verify that all of the applicable components are working properly. This test is generally called a "post-print" of the toner cartridge. The most common way to achieve this is to actually use the cartridge to conduct a printing operation after it has been repaired or remanufactured. As the toner cartridge is printing pages, the printed pages are inspected to verify their quality and proper operation of the cartridge. This post-print test will show if any of the components need to be re-worked and/or changed before shipping the toner cartridge to the end user.

Most types of cartridges contain a seal that prevents the toner from leaking during shipping. In those instances, one cannot conduct a post print test since the toner in the toner hopper does not have accessibility to the developing section. To conduct this post-print test after the cartridge has been assembled, a small amount of toner, approximately 10 to 20 grams, is placed on the developing roller so the post-print procedure can be accomplished. After the post-print toner has been applied to the developing roller section, the toner cartridge assembly will be completed. The completed cartridge is then placed into an appropriate printer. Several standard test pages are printed, and these pages contain several, different graphic images that provide indications of the general condition of the cartridge. If any problem is revealed from the images shown on the printed graphics on the test pages, then the cartridge is removed and re-worked to fix or eliminate each of such problems. Although this test does use several grams of toner, it typically does not consume all of the toner that has been placed in the developing section of the cartridge.

During the post-test, an indication on the printing pages that most of the post-test toner has been used occurs when the pages start to show toner starvation. With magnetic toner developing systems an indication of toner starvation occurs when the post-test printing pages start to print white pages only. Nevertheless, these cartridges typically contain some residual toner, and this residual toner can be the source of the leakage or "sweating" problem described above. It has been discovered that this leakage or sweating problem is relatively less severe for cartridges containing magnetic toner developing systems, and relatively more severe or pronounced for cartridges containing non-magnetic toner developing systems, which are usually found in cartridges used in full-color printers containing colored toner.

The non magnetic toner developing system cartridges that have developer rollers that are not magnetic present a more serious problem simply because of that fact. A magnetic roller will tend to hold on to most of the post-print toner by using a magnetic force, but a non-magnetic roller, once in the printer, will attract the toner using an electro-static charge. Once the cartridge is taken out of the printer, there is no charge applied to the roller, thus there is no electro-static forces between the roller and the toner causing the toner to fall off the roller. It has been discovered that the post-test toner in cartridges with non-magnetic rollers will tend to leak/sweat out during the shipping process. Another major problem with the non-magnetic toner system is that since the toner doesn't hold to the developer roller once the cartridge is not in the printer, there is a chance that the excess will accumulate on other components, potentially causing permanent printing defects. Two major components that exhibit this problem are the PCR (Primary Charge Roller) and the OPC (Optical Photo Conductor).

SUMMARY OF THE INVENTION

To address the aforementioned problems processes described herein provide for removing excess toner left in a repaired or remanufactured laser printer toner cartridge after the cartridge has been through a post-printing test. In one embodiment the process includes providing a hole in the cartridge large enough to permit vacuuming the excess toner out of the cartridge. Preferably the hole is at one end of the cartridge. Preferably the cartridge is oriented so that the hole is at a lower elevation relative to the majority of the cartridge so that gravity will assist in removing the excess toner. Also, preferably, the cartridge is vibrated during vacuuming to maximize dislodgement of toner inside of the cartridge and further facilitate its removal. The cartridge may be place in a fixture prior to vacuuming so that the entire fixture could be vibrated and oriented as desired. The hole is then patched to prevent subsequent leakage of toner out of the cartridge.

In another embodiment excess toner is removed through cartridge toner hopper exit pull seal port. Preferably the cartridge is oriented vertically, with the exit seal port at the lower end, and preferable is also placed in a fixture. A vacuum nozzle, shaped to conform to the shape of the exit seal port, is placed over the exit port and the excess toner is vacuumed out of the cartridge. Also, the fixture is preferably vibrated during vacuuming to facilitate removal of the toner.

These and other embodiments, features, aspects, and advantages of the invention will become better understood with regard to the following description, appended claims and accompanying drawings.

BRIEF DESCRIPTION OF THE DRAWINGS

The foregoing aspects and the attendant advantages of the present invention will become more readily appreciated by reference to the following detailed description, when taken in conjunction with the accompanying drawings, wherein.

Reference symbols or names are used in the Figures to indicate certain components, aspects or features shown therein. Reference symbols common to more than one Figure indicate like components, aspects or features shown therein.

DETAILED DESCRIPTION

With reference to FIGS. 1-6 two embodiments of processes for evacuating excess toner from repaired or remanufactured laser printer toner cartridges after the post-test will be described. The first process is referred to as the exit pull seal port method and the second is referred to as the exit vacuum hole method.

Figure 1:
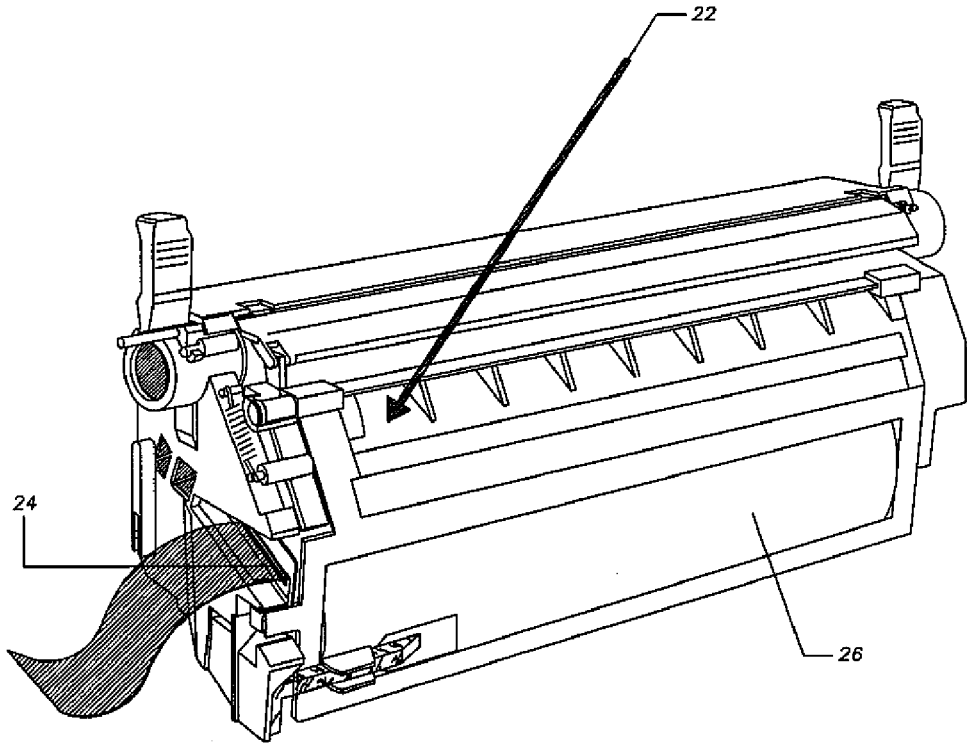
FIG. 1 is a perspective view of a toner cartridge showing the location of an excess toner evacuation hole of a first embodiment.

Referring to FIG. 1, the exit vacuum hole method involves drilling a hole at location (22) that is big enough to vacuum the excess toner in a reasonable amount of time out of the toner cartridge. Specifically, the toner found on the outer surface of the cartridge on one end of the roller is removed. That end is preferably the same end as is the exit pull seal port (24). The port (24) penetrates to or opens into the inside of the developing section of the cartridge. Optionally, the cartridge can be vibrated during the vacuuming process in order to increase the rate at which the toner will be removed from the toner cartridge and maximize removal of excess toner.

Figure 2:
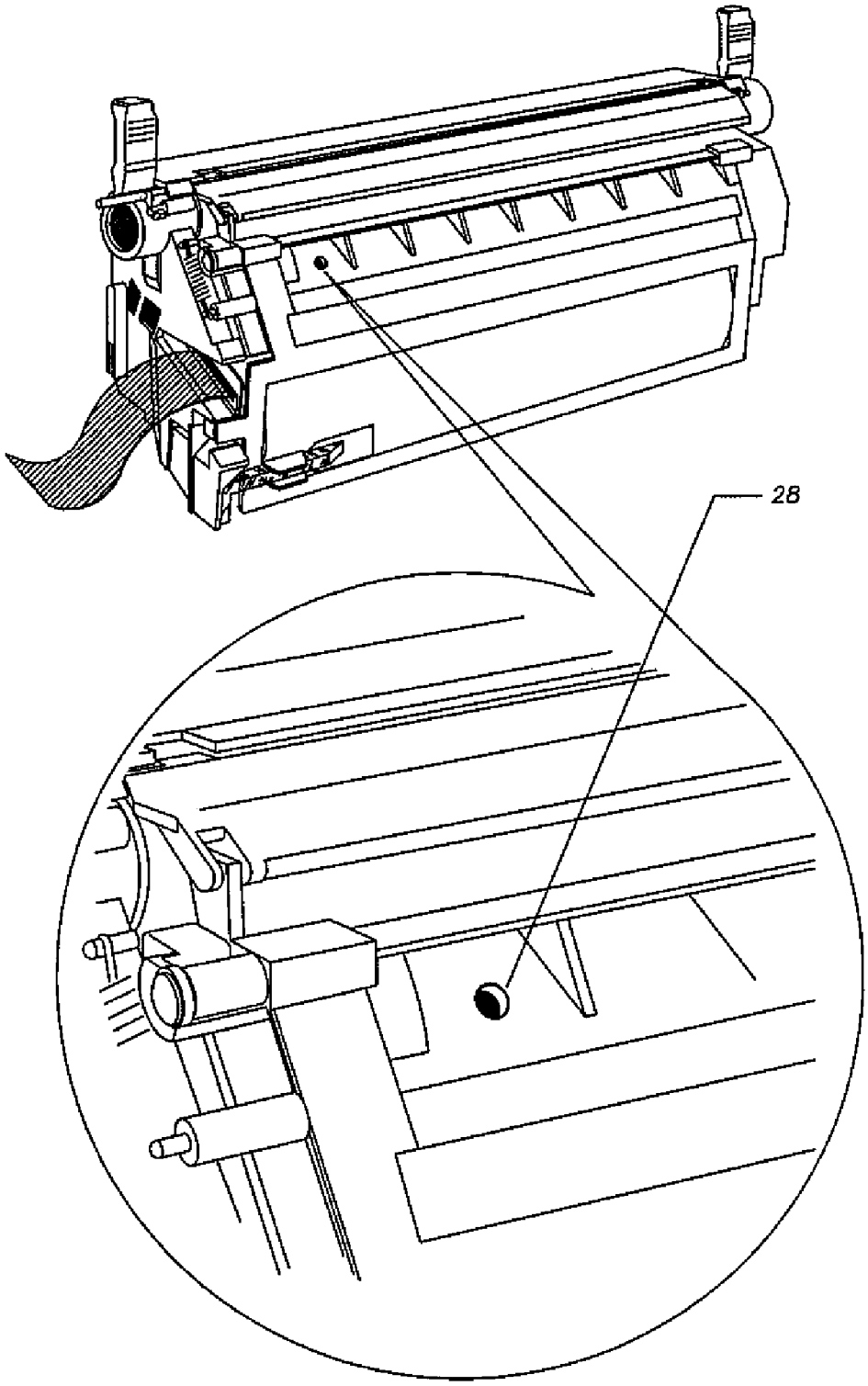
FIG. 2 is a perspective view, with enlarged area showing the exit hole of the FIG. 1 embodiment.

Referring to FIG. 2, the hole is preferably drilled into the cartridge at the disassembly stage of the cartridge repair or remanufacturing process, in order to prevent damage to the internal components in the developing section. Furthermore, drilling the hole at this stage provides the ability to clean excess plastic burrs from the inside of the developing section before the cartridge is assembled. As shown in FIG. 2, the hole 28 has been drilled or otherwise made at location (22) shown in FIG. 1. After the hole (28) has been drilled, it is temporarily sealed during the rest of the remanufacturing process in order to prevent leakage of toner through the hole in the post-print test stage. The hole is preferably and temporarily covered with a piece of tape, of any variety, so long as the tape functions to prevent leakage during post-test. After the post-print test has been completed, the temporary tape seal is removed. The excess toner is then vacuumed.

Figure 3A:
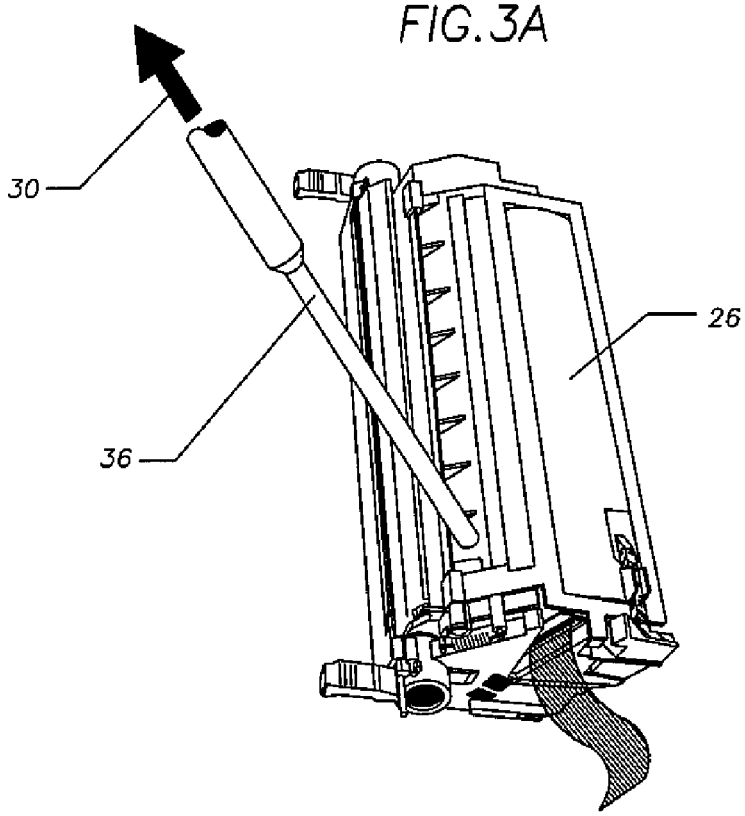
FIG. 3A is a perspective, vertically oriented view of the FIG. 1 embodiment showing the vacuuming nozzle.
Figure 3B:
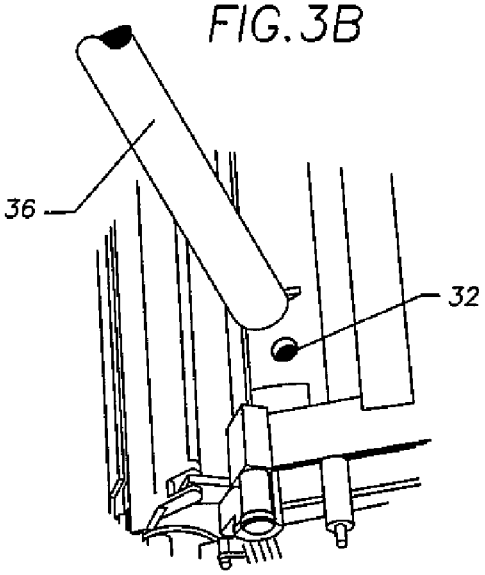
FIG. 3B is a close-up, perspective view of the FIG. 1 embodiment with the vacuuming nozzle about to be placed over the exit hole.
Figure 3C:
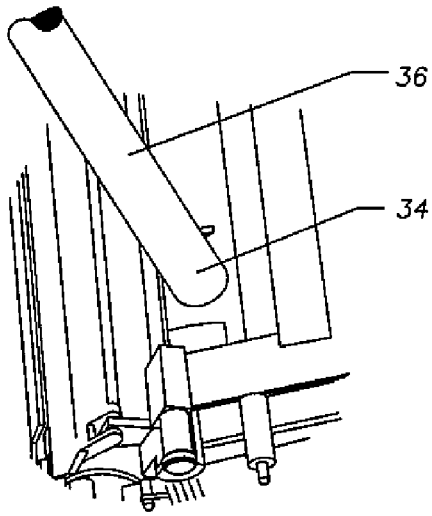
FIG. 3C is a close-up, perspective view of the FIG. 1 embodiment with the vacuuming nozzle placed over the exit hole.

With reference to FIGS. 3A, 3B and 3C, vacuuming of the cartridge after post-test is accomplished by placing the cartridge on a holding fixture, preferably in a vertical orientation and then vacuuming out the excess toner. The vertical orientation tends to permit gravity to force the toner to drop to the bottom and thus closer to the exit hole 28 during vacuuming, as shown at location (32) in FIG. 3B. A vacuum nozzle (36) is used to vacuum out the excess toner from the cartridge (26) in the direction of the arrow (30) as shown in FIG. 3A. The hole (28) is located on the bottom side (32) of the cartridge as shown in FIG. 3B. A vacuum nozzle (36) is positioned around and over the hole (28) and this is where the toner is to be removed, as shown at (34) in FIG. 3C. The vacuum process can either be accomplished on a vibrating fixture (not shown) to enhance the flow of toner to the vacuum nozzle, or be accomplished without vibration, for toner removal.

Figure 6:
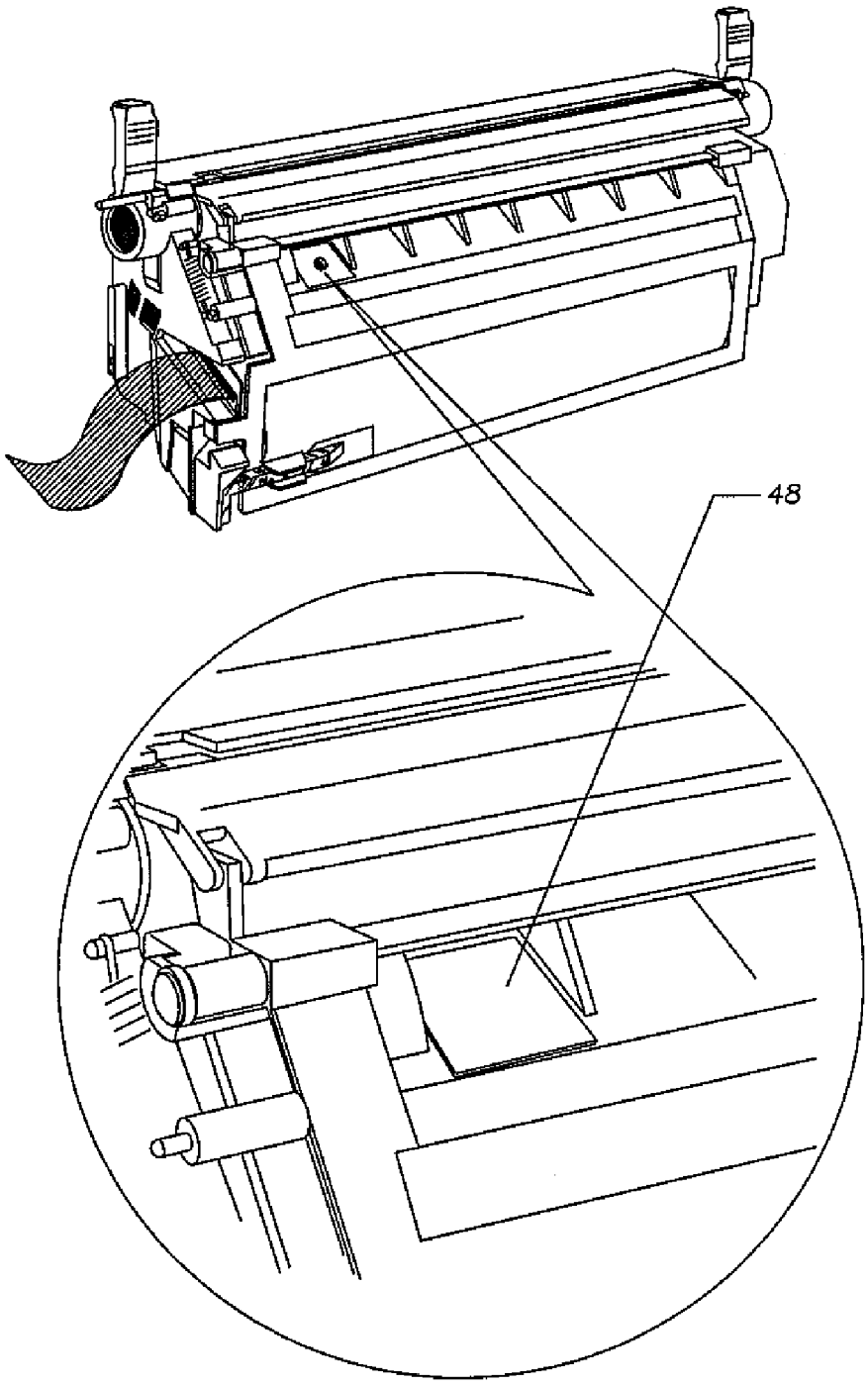

Referring to FIG. 6, once the excess toner has been removed, the area around the drilled hole (28) is cleaned and a seal patch (48) is applied to close and seal the hole (28). Any seal, cover, plug or cap can be used to cover and seal the hole from leakage, as long as it doesn't interfere or damage the internal components of the printer, i.e., so long as it functions as a seal or plug only.

Figure 4:
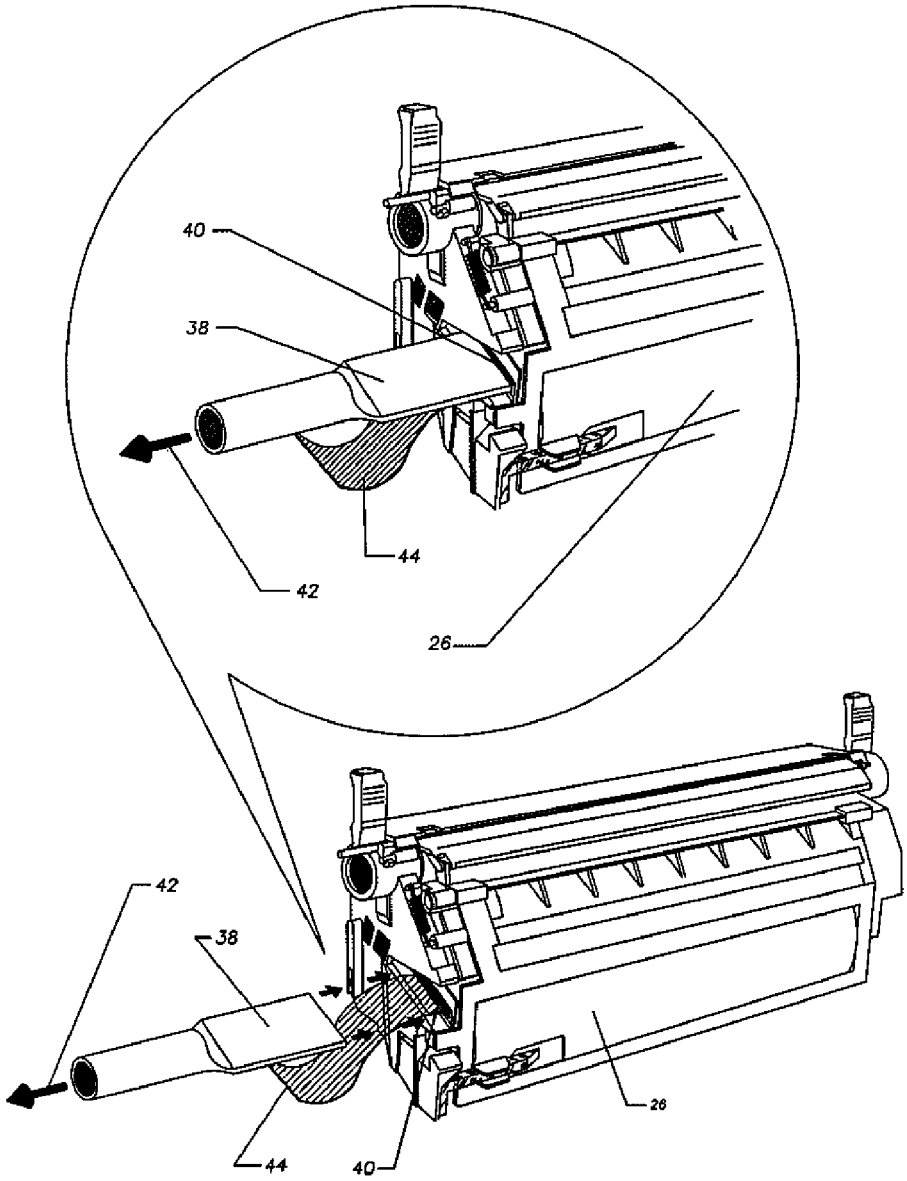
FIG. 4 is a perspective view of an alternate embodiment of the present vacuuming process.

With reference to FIG. 4, and alternate method of removing excess toner from a laser printer cartridge will be described. This alternate method is referred to as the exit pull seal port method. In this method for removing the post-test toner from the developing section of a cartridge, toner is removed from the toner hopper exit pull seal port. In this method the toner cartridge preferably is placed vertically. Alternatively, the cartridge can be placed at any angle that is convenient in relation to the fixture that holds the cartridge in place. Also, preferably, the cartridge is vibrated in order to agitate and shake loose any toner that might be retained on post-test toner cartridge. Alternative, tapping the cartridge by hand will also cause the toner to fall to one end of the cartridge, thus, allowing for maximum removal of the excess toner to be removed by the vacuum nozzle as shown at (38).

During this method the vacuum nozzle (38) is slipped into the toner hopper seal port (40) above the seal strip (44). Care must be taken that the nozzle does not damage or push the strip (44) back into the cartridge. At this point, vacuum is applied to suck out toner in the direction shown by arrow (42) to remove the excess post-test toner through the hopper seal port (40). Optionally, the nozzle (38) can be custom shaped to correspond to the shape of the exit port of specific toner cartridge models or designs, by either machining or molding a generic design nozzle. The specific cartridge customized nozzle is slipped into the exit pull seal port (40) to allow the toner to be removed faster than with a generic nozzle.

Figure 5A:
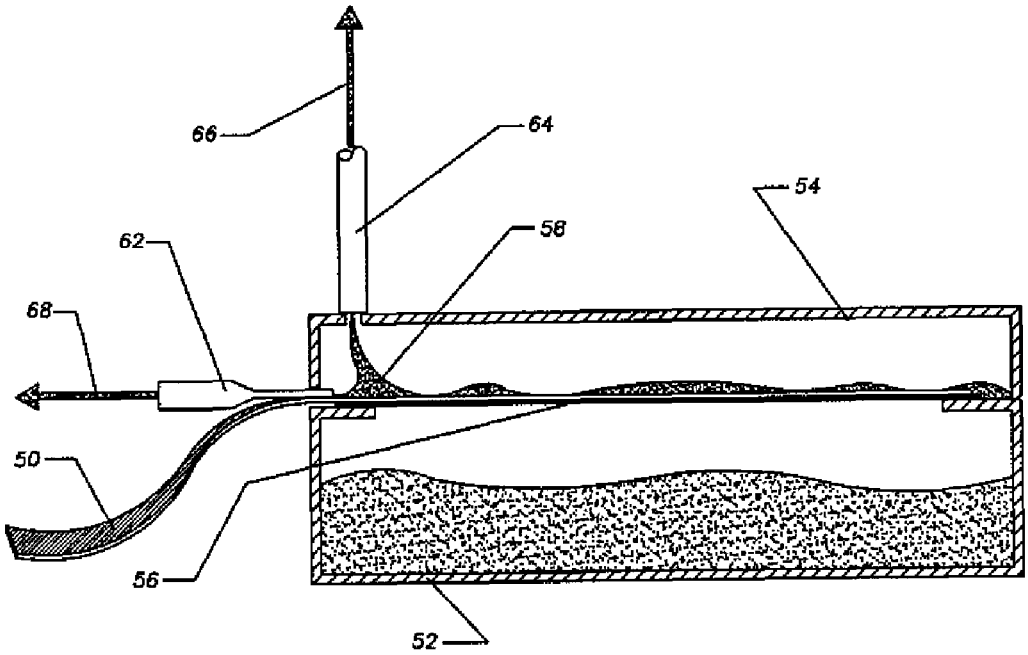
FIG. 5A is a schematic view showing the principles of the present process as simplified and applied to both the FIG. 1 and FIG. 4 embodiments.
Figure 5B:
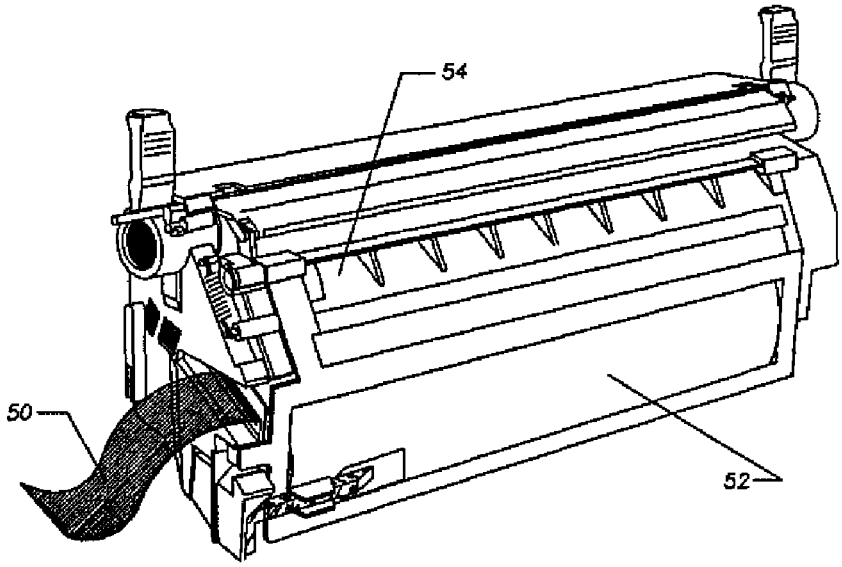
FIG. 5B is a side perspective view of the exterior of a cartridge as schematically shown in FIG. 5A, and, FIG. 6 is a perspective view of a toner cartridge showing a cover for the exit hole.

To illustrate the general toner evacuation process as presently described for two different embodiments, reference is made to FIGS. 5A and 5B. A simplified section view of a laser printer cartridge toner hopper tank (52) and waste section (54) is shown. Also, post-test toner (58) is shown lying on top of a toner hopper tank with the toner hopper pull seal strip (50) and hopper gasket seal dividing the two sections at (56). FIG. 5B is a side perspective view of a toner cartridge, and includes the hopper section (52), the roller section (54) and the pull seal (50). The post-test toner (58) shown on top of the toner hopper gasket at (56) and pull seal strip assembly (50) is to be evacuated. In FIG. 5A both of the two different, and alternate vacuum nozzles (62), (64) are shown to graphically show the removal (58) of toner in simplified and comparative manner. The arrows (66) and (68) at the end of the vacuum nozzles show the direction of vacuum removal of toner from the toner waste tank hopper (54). In both process the addition of vibration agitates the toner, and/or vertical orientation provides for quicker and better removal of post-test toner.

Although specific embodiments of the invention have been described, various modifications, alterations, alternative constructions, and equivalents are also encompassed within the scope of the invention. The specification and drawings are, accordingly, to be regarded in an illustrative rather than a restrictive sense. It will, however, be evident that additions, subtractions, deletions, and other modifications and changes may be made thereunto without departing from the broader spirit and scope of the invention as set forth in the claims.

What is claimed is:

1. A method of removing excess toner remaining on a toner hopper pull seal strip after performance of a post-test of a remanufactured toner cartridge, the toner hopper pull seal strip having a first surface facing towards a toner hopper of the cartridge and second surface facing away from the toner hopper of the cartridge, the method comprising:

during disassembly of the toner cartridge for remanufacture, forming a hole in the toner cartridge, the hole allowing access to an interior volume of the toner cartridge adjacent to the second surface of the pull seal strip;

temporarily closing the hole during reassembly of the toner cartridge and post- test;

after post-test, reopening the hole;

applying a vacuum to the hole to remove the excess toner from hopper pull seal strip; and applying a seal patch to the hole.

2. The method of removing excess toner remaining on a toner hopper pull seal strip after performance of a post-test of a remanufactured toner cartridge of claim 1, where forming a hole comprises drilling a hole.

3. The method of removing excess toner remaining on a toner hopper pull seal strip after performance of a post-test of a remanufactured toner cartridge of claim 2, further comprising cleaning excess plastic burrs from the toner cartridge after drilling the hole.

4. The method of removing excess toner remaining on a toner hopper pull seal strip after performance of a post-test of a remanufactured toner cartridge of claim 1, wherein applying a vacuum to the hole to remove the excess toner comprises:

placing a vacuum nozzle over the hole;

activating a vacuum source; and vacuuming the excess toner out of the cartridge.

5. The method of removing excess toner remaining on a toner hopper pull seal strip after performance of a post-test of a remanufactured toner cartridge of claim 1, further comprising vibrating the toner cartridge while applying a vacuum to the hole.

6. The method of removing excess toner remaining on a toner hopper pull seal strip after performance of a post-test of a remanufactured toner cartridge of claim 1, wherein temporarily closing the hole during reassembly of the toner cartridge and post-test comprises closing the hole with a tape seal.

* * * * *